US007740712B2

(12) United States Patent
Bechini

(10) Patent No.: US 7,740,712 B2
(45) Date of Patent: Jun. 22, 2010

(54) UNIT FOR WASHING CONTAINERS

(75) Inventor: Claudio Bechini, Castelnuovo Berardenga (IT)

(73) Assignee: I.M.A. Industria Macchine Automatiche S.p.A.

( * ) Notice: Subject to any disclaimer, the term of this patent is extended or adjusted under 35 U.S.C. 154(b) by 162 days.

(21) Appl. No.: 11/794,958

(22) PCT Filed: Jan. 11, 2006

(86) PCT No.: PCT/IB2006/000048

§ 371 (c)(1),
(2), (4) Date: Jul. 10, 2007

(87) PCT Pub. No.: WO2006/075237

PCT Pub. Date: Jul. 20, 2006

(65) Prior Publication Data

US 2008/0092934 A1 Apr. 24, 2008

(30) Foreign Application Priority Data

Jan. 12, 2005 (IT) ..... BO2005A0012

(51) Int. Cl.
*B08B 9/08* (2006.01)

(52) U.S. Cl. ..... 134/167 R

(58) Field of Classification Search ..... 134/167 R
See application file for complete search history.

(56) References Cited

U.S. PATENT DOCUMENTS

| | | | | |
|---|---|---|---|---|
| 2,196,027 | A | 4/1940 | Risser | |
| 4,099,674 | A | 7/1978 | Standley | |
| 5,135,014 | A * | 8/1992 | Beswick | 134/60 |
| 2003/0232150 | A1 | 12/2003 | Arnold et al. | |

FOREIGN PATENT DOCUMENTS

| | | |
|---|---|---|
| DE | 19952533 | * 10/1999 |
| FR | 2 417 469 | 9/1979 |
| GB | 354 629 | 8/1931 |

OTHER PUBLICATIONS

Machine translation of DE19952533.*
Machine translation of DE 19952533 (published Oct. 1999).*
International Search Report mailed May 19, 2006.

* cited by examiner

*Primary Examiner*—Michael Cleveland
*Assistant Examiner*—Samuel A Waldbaum
(74) *Attorney, Agent, or Firm*—Nixon & Vanderhye P.C.

(57) ABSTRACT

A unit for washing containers comprises a conveying device for supporting and advancing in an orderly manner said containers to a grasping, moving and washing device; the grasping, moving and washing device comprises at least a conveyor provided with a grasping arrangement for grasping in succession groups of said containers from said conveying device at a first operating position and at least a bank of nozzles for dispensing and diffusing washing liquid substances inside the containers; the unit further comprises a moving actuating arrangement for moving with reciprocating motion in relation to each other said conveyor and the bank of nozzles for causing the insertion of the nozzles inside the groups of said containers at a second operating position.

4 Claims, 1 Drawing Sheet

UNIT FOR WASHING CONTAINERS

This application is the U.S. national phase of PCT International Application No. PCT/IB2006/000048 filed on 11 Jan. 2006. PCT/IB2006/000048 claims priority to IT Application No. BO2005A000012 filed on 12 Jan. 2005. The entire contents of these applications are incorporated herein by reference.

The present invention forming a part of the technical field relating to the packaging of pharmaceutical products in a protected environment.

In particular, the invention refers to a unit for washing and decontaminating containers, e.g. bottles, suitable for being subsequently filled with pharmaceutical products, in liquid or powder form, to which the following disclosure will refer explicitly without thereby losing in generality.

Currently, the known operating washing machines for washing bottles which are used in particular in the pharmaceutical field operate at production speeds that are often reduced and which it is difficult to increase.

This is due not only to the bulky and complex bottle conveying and handling system but in particular to the system for managing and moving the washing nozzles that have to be inserted inside the bottles for diffusing inside the bottles the washing and decontaminating liquid.

An object of the present invention is therefore to provide a washing unit that is free of the drawbacks of the prior art disclosed above.

In particular, an object of the present invention is to realize a bottle washing unit that carries out rapid and efficient washing and that is provided with very compact dimensions.

According to the present invention, a unit for washing containers is provided, comprising a conveying device for supporting and advancing in an orderly manner said containers to a grasping, moving and washing device; said grasping, moving and washing device comprising at least a conveyor provided with a grasping arrangement for grasping in succession groups of said containers from said conveying device at a first operating position, and at least a bank of nozzles for dispensing and diffusing washing liquid substances inside the containers; wherein the unit further comprises a moving actuating arrangement for moving with reciprocating motion in relation to each other said conveyor and said bank of nozzles for causing the insertion of the nozzles inside the corresponding groups of said containers at a second operating position.

Figure 1:
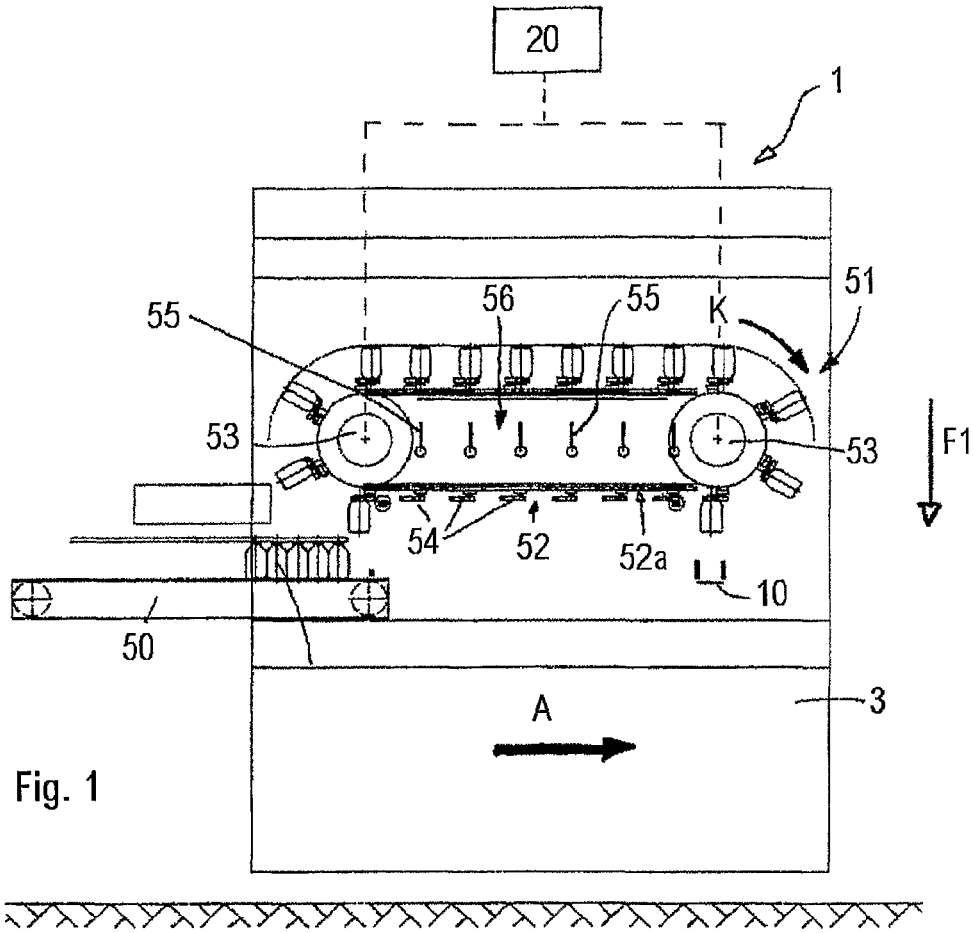
Figure 2:
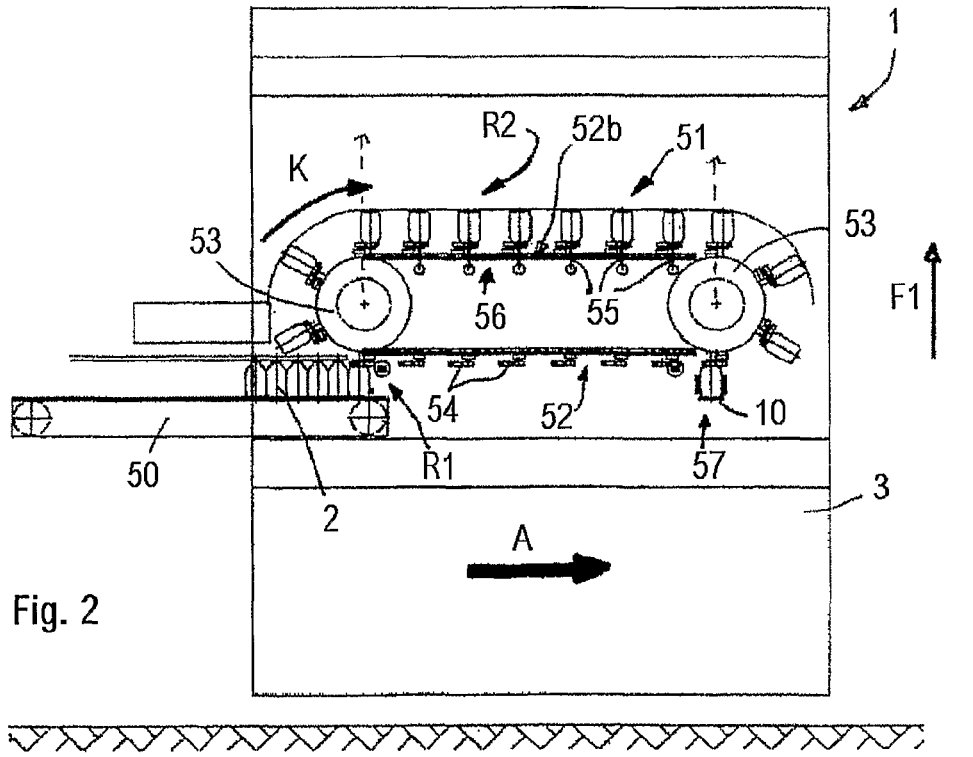

The technical features of the invention according to the aforementioned objects are clearly ascertainable by the contents of the claims set out below and the advantages thereof will be clearer in the following detailed disclosure made with reference to the attached drawings that show an embodiment thereof purely by way of non-limitative example in which:

FIG. 1 is a partially sectioned schematic frontal view and with parts removed for clarity, of an embodiment of a containers washing unit according to the present invention and in a first operating position; and FIG. 2 shows, still in a schematic frontal view, the unit in FIG. 1 in a second operating position.

With reference to the attached FIG. 1, 1 indicates overall a washing unit intended for carrying out washing and decontaminating of empty bottles 2 in relation to any residue, organic or inorganic, present inside the bottles 2, for example before subsequent filling thereof with pharmaceutical product in liquid or powder form.

The washing unit 1 is defined by a structure 3 with compact dimensions and comprises a conveying plane 50 suitable for defining a support thereof on which the empty bottles 2 are deposited to be supplied in an orderly manner in a horizontal advancing direction A, with their open inlets facing upwards to a conveyor 51 of the belt 52 type wound in a loop and movable in step mode around corresponding pulleys 53 and supporting a plurality of grasping grippers 54. According to what has been illustrated in FIG. 2, during moving in step mode of the belt 52 around the pulleys 53 (direction K in FIGS. 2*a* and 2*b*), at a lower operating position R1 the grippers 54 temporarily arranged on the lower branch 52*a* of the belt 52 are each suitable for grasping by the neck a corresponding bottle 2 from the plane 50 and advancing a corresponding group of bottles 2 up to the bottles 2 of the group are overturned by 180° in relation to the position taken on the plane 50, namely with their open inlet facing downwards.

In this configuration (upper branch 52*b* of the belt 52), the entire conveyor 51 is suitable for moving, by a known moving actuating arrangement, indicated overall with a block 20 in FIG. 1 and applied to the aforementioned pulleys 53 vertically downwards (arrows F1 in FIGS. 1 and 2) reaching a second operating position R2 in which each nozzle 55 of a bank 56 of washing nozzles 55 is suitable for being inserted through the open inlet inside a corresponding bottle 2 overturned in such a way as to be able to spray the inside of the bottle 2 with a sterilising washing liquid (contained inside a suitable known and not illustrated supplying tank and connected to the nozzles 55 by conduits that are also known and not illustrated).

As can be better observed in FIG. 2, owing to the structure of the conveyor 51 that is movable with reciprocating motion in a vertical direction, the removing and grasping position R1 of a first group of bottles 2 from the plane 50 and the inserting position R2 of the nozzles 55 into the bottles 2 of a subsequent group of bottles 2 arranged on the upper branch 52b and therefore with the washing of the bottles 2 of the this subsequent group are achieved simultaneously, with great simplification of movements and overall dimensions.

In other words, during use, grasping of the aforementioned first group of bottles 2 from the plane 50 through the grippers 54 supported by the belt 52 in the position R1 is achieved during inserting of the nozzles 55 inside the bottles 2 of the subsequent group at the operating position R2.

Lastly, the unit 1 comprises an outlet portion 57, at which the washed and decontaminated bottles 2 are unloaded from the conveyor 51 with grippers 54 and deposited in succession onto an outlet conveyor 10.

The outlet conveyor 10 is, in the representation in FIG. 2, arranged transversely to the direction A, but it is of course possible to also provide the outlet conveyor arranged parallel to the direction A and aligned on the plane 50. Furthermore, in a version that is not illustrated, the conveyor 51 is provided fixed in relation to the bank 56 of nozzles 55, whereas the latter are fitted movable with reciprocating motion from and to the bottles 2 to be inserted inside the bottles 2 and to achieve the washing thereof.

The unit 1 is therefore not only provided with compact dimensions but is above all able to operate at high production speeds, owing to the conveyor 51 that is vertically movable that with a sole movement enables both a group of bottles 2 to be removed by the grippers 54 and a successive group of bottles 2 that are overturned and retained by the grippers 54 to be simultaneously lowered.

It is understood that everything disclosed above has been disclosed purely by way of non-limitative example. Possible modifications to and variations on the invention are therefore considered to fall within the extent of the protection accorded to this technical solution as disclosed above and claimed below.

The invention claimed is:

1. Unit for washing pharmaceutical containers, comprising a conveying device for supporting and advancing in an orderly manner said containers to a grasping, moving and washing device; said grasping, moving and washing device comprising at least a grasping conveyor provided with a grasping arrangement for grasping in succession groups of said containers from said conveying device at a removing and grasping position and at least a bank of nozzles for dispensing and diffusing washing liquid substances inside the containers; wherein the unit further comprises a moving actuating arrangement for moving vertically with reciprocating motion said grasping conveyor from and to said bank of nozzles for causing the insertion of the nozzles inside the corresponding groups of said containers at an inserting position, wherein said grasping conveyor comprises a belt movable in step mode around corresponding pulleys and is provided with grippers for grasping the containers, and wherein said grasping conveyor is movable by said moving actuating arrangement and is positioned relative to said bank of nozzles such that grasping of one of said groups of containers from said conveying device by said grippers in the removing and grasping position and inserting the nozzles inside another group of containers in the inserting position are achieved simultaneously.

2. Unit for washing pharmaceutical containers, comprising a supporting conveyor for supporting and advancing in an orderly manner said containers to a grasping, moving and washing device; said grasping, moving and washing device comprising at least a grasping conveyor provided with a grasping arrangement for grasping in succession groups of said containers from said conveying device at a removing and grasping position and at least a bank of nozzles for dispensing and diffusing washing liquid substances inside the containers; wherein the unit further comprises a moving actuating arrangement for moving vertically with reciprocating motion said grasping conveyor from and to said bank of nozzles for causing the insertion of the nozzles inside the corresponding groups of said containers at an inserting position, wherein said grasping conveyor comprises a belt movable in step mode around corresponding pulleys and is provided with grippers for grasping the containers, and wherein said grasping conveyor is movable by said moving actuating arrangement and is positioned relative to said bank of nozzles such that grasping of one of said groups of containers from said conveying device by said grippers in the removing and grasping position and inserting the nozzles inside another group of containers in the inserting position are achieved simultaneously.

3. Unit according to claim 2, wherein said moving actuating arrangement moves said grasping conveyor vertically with reciprocating motion from a first operating position wherein neither said removing and grasping position nor said inserting position are achieved to a second operating position wherein said removing and grasping position and said inserting position are achieved simultaneously.

4. Unit for washing pharmaceutical containers, comprising:

a conveying device for supporting and advancing in an orderly manner said containers;

a grasping, moving and washing device cooperable with and positioned relative to said conveying device to grasp said containers, wherein said grasping, moving and washing device includes:

at least a grasping conveyor positioned adjacent said conveying device and provided with a grasping arrangement that grasps groups of said containers in succession from said conveying device at a removing and grasping position, and at least a bank of nozzles that dispenses and diffuses washing liquid substances inside the containers; and a moving actuating arrangement cooperable with said grasping conveyor and moving said grasping conveyor with a reciprocating motion to and from an inserting position, wherein said bank of nozzles is positioned relative to said grasping conveyor such that in said inserting position, the nozzles are disposed inside the corresponding groups of said containers, wherein said conveying device, said grasping, moving and washing device and said moving actuating arrangement are relatively positioned and arranged such that said grasping conveyor is simultaneously positionable in said removing and grasping position and said inserting position.

* * * * *

UNITED STATES PATENT AND TRADEMARK OFFICE

CERTIFICATE OF CORRECTION

PATENT NO. : 7,740,712 B2
APPLICATION NO. : 11/794958
DATED : June 22, 2010
INVENTOR(S) : Bechini It is certified that error appears in the above-identified patent and that said Letters Patent is hereby corrected as shown below:

On the Title Page

Delete Item "(73) Assignee: I.M.A. Industria Macchine Automatiche S.p.A." and insert Item --(73) Assignee: IMA LIFE S.R.L.--.

Signed and Sealed this
Twenty-ninth Day of March, 2011

David J. Kappos

David J. Kappos
*Director of the United States Patent and Trademark Office*